United States Patent [19]

Rick et al.

[11] 4,267,431

[45] May 12, 1981

[54] ELECTRIC HAIR CURLING APPARATUS HAVING A MOTOR-DRIVEN ROTATABLE HAIR WRAPPING MEMBER

[75] Inventors: Randy L. Rick; Paul F. Mazzotta; Cosimo D. Daiello, all of Reading, Pa.

[73] Assignee: Shearpower International Corporation, Reading, Pa.

[21] Appl. No.: 972,356

[22] Filed: Dec. 22, 1978

[51] Int. Cl.[3] ..... H05B 1/00; A45D 1/02

[52] U.S. Cl. ..... 219/225; 132/7; 132/32 R; 132/34 R; 132/37 R; 219/230

[58] Field of Search ..... 219/222, 224–226, 219/230; 132/31 R, 31 A, 32 R, 32 A, 32 B, 32 C, 33, 34 R, 34 A, 34 B, 34 C, 37 R, 37 A, 7, 9

[56] References Cited

U.S. PATENT DOCUMENTS

| | | | |
|---|---|---|---|
| 516,744 | 3/1894 | Payne | 132/34 R |
| 917,580 | 4/1909 | Gemmell | 132/34 R |
| 1,857,689 | 5/1932 | Melkman | 132/34 R |
| 1,929,012 | 10/1933 | Boda | 132/31 R |
| 2,524,058 | 10/1950 | Kamara | 132/34 R |

FOREIGN PATENT DOCUMENTS

| | | | |
|---|---|---|---|
| 305521 | 2/1933 | Italy | 132/37 R |
| 316769 | 4/1934 | Italy | 132/37 R |

*Primary Examiner*—A. Bartis

*Attorney, Agent, or Firm*—William H. Elliott, Jr.

[57] ABSTRACT

An electric hair curling apparatus includes an elongated electrically heated barrel extending from a handle and forming a mandrel about which hair may be wrapped to form a curl. The barrel is mounted for rotation about its longitudinal axis relative to the handle and a selectively energized electric motor is provided in the handle for unidirectionally rotating the barrel. An elongated spring-biased wrapping member conforming in shape to the barrel is mounted on the barrel for rotation therewith and is arranged for movement toward the barrel to urge the hair against the barrel and away from the barrel to relax its engagement with the hair. Cooperating camming means on the handle and wrapping member automatically and periodically move the wrapping member toward and away from the barrel, during each revolution of the barrel, in response to the unidirectional rotation of the barrel by the motor.

8 Claims, 11 Drawing Figures

ELECTRIC HAIR CURLING APPARATUS HAVING A MOTOR-DRIVEN ROTATABLE HAIR WRAPPING MEMBER

FIELD OF THE INVENTION

This invention relates to the hair styling art and specifically to hand-held equipment for curling or waving hair.

BACKGROUND OF THE INVENTION

One of the basic procedures of hair styling is curling or waving hair. Early equipment, the so-called marcel iron, had a rod or barrel and a clamp that held the hair against the barrel. The hair is clamped, rolled onto the barrel, and, as the iron is heated, a curl is set into the hair. More hair curlers that are sold both for home and professional use today are modern adaptations of the basic marcel iron. The procedure for using these irons is to open the clamp, capture the hair ends between the clamp and the barrel, and then roll the curler toward the scalp so that the hair strands wrap about the barrel and clamp. Usually, the barrel is heated or incorporates a steam-generating system for heating the hair to set the curl.

It has been found that tight, well formed curls are better produced if the curling procedure is initiated with the curler near the scalp, the rolling or wrapping of the hair strands about the curling iron proceeding from the scalp outwardly toward the hair ends. This is believed to result from the fact that, in procedures where curling begins near the scalp, each convolution of the curl, including those near the scalp, are relatively small, thereby resulting in a well set, even curl. The previously mentioned fixed-barrel type of curler is very difficult to use for curling procedures initiated near the scalp. In consequence, most nonprofessionals only use a curling technique in which the curling begins at the hair ends and proceeds toward the scalp, the curl formed in progressively larger, concentric convolutions as the iron is rolled toward the scalp. In this curling method, the largest convolution of hair forming the curl is the one closest to the scalp. Thus, it is extremely difficult for a home user to achieve professional quality curling with the curling equipment that has been supplied for home use. Moreover, professionals acquire facility with equipment now available only after long experience.

Curling irons with motor-driven, rotatable barrels have been proposed. One example of a prior design is shown in U.S. Pat. No. 2,608,195 to Ledbetter. Such designs employ clamps that are biased to hold the hair against the barrel and that are manually actuated to relax the clamping of the hair to the barrel of the curler. It is believed that it would be difficult to achieve good hair curling techniques with such equipment because the clamp is manually actuated; these designs would be cumbersome and they would tend to be tiresome to use.

SUMMARY OF THE INVENTION

It is an object of this invention to provide hair curling equipment that operates automatically.

It is also an object of this invention to provide manageable, easy to use apparatus for curling and waving the hair.

It is a further object of this invention to provide a curler that will automatically perform curling procedures that begin near the scalp, at the hair ends, or intermediate these points, even in the hands of an inexperience user.

These and other objects of the invention are achieved by the use of a curler device employing a motor-driven, rotatable barrel and a wrapping member for wrapping the hair about the barrel and urging the hair against the barrel. The wrapping member rotates with the barrel and alternately urges the hair toward the barrel and relaxes the urging of hair toward the barrel as the barrel rotates. In a preferred embodiment, such alternate movement is imparted to the wrapping member by cam structure cooperative between the barrel and the housing of the curler. Curling can commence next to the scalp, at the hair ends, or at intermediate points (depending upon hair length and the desired style) and continue, in an automatic and uninterrupted fashion, until all or a desired length of hair is formed into a curl.

DESCRIPTION OF THE PREFERRED EMBODIMENT

Figure 1:
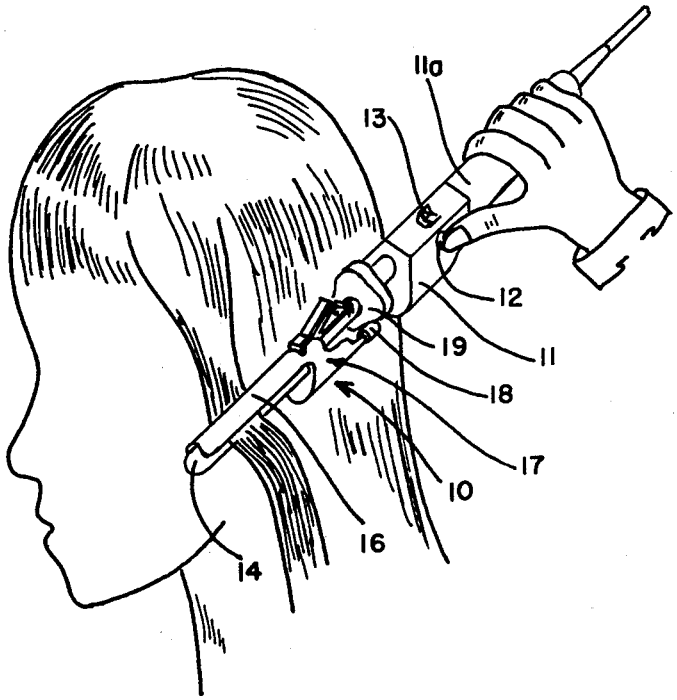
FIG. 1 shows a hair curler in accordance with the present invention as the hair is being placed between the barrel and the wrapping member.

Referring to FIG. 1, the preferred form of hair curler 10 comprises a housing 11 that is shaped and sized so as to be easily held by one hand of the user. The housing includes a normally open push button switch 12 and a two-position on/off switch 13, both of which are located to be actuated while the housing 11 is being held in the user's hand. The functions of switches 12 and 13 will be described below.

The curler has a barrel 14 that rotates with respect to housing 11. A wrapping member 16 is pivotally mounted to barrel 14 and rotates with the barrel. The wrapping member 16 serves to wrap the hair about barrel 14 and to urge the hair against the barrel from time to time. The barrel and the hair-engaging surfaces of the wrapping member may be coated with a low-friction material, for example, Teflon, so that the hair can slip with respect to the barrel and wrapping member. This reduces the likelihood that the hair will be overtensioned or pulled as it is curled.

The wrapping member 16 is biased to urge the hair against the barrel and includes an actuating portion 17 that carries a cam follower 18. The cam follower 18 rests against a cam 19 that is held stationary on the housing 11 adjacent to the base portion of barrel 14. When the barrel 14 rotates, the cam 19 imparts a pivoting motion to the wrapping member 16 so that the member 16 alternately urges the hair against the barrel and then relaxes its engagement with the hair as the barrel 14 rotates.

Figure 2:
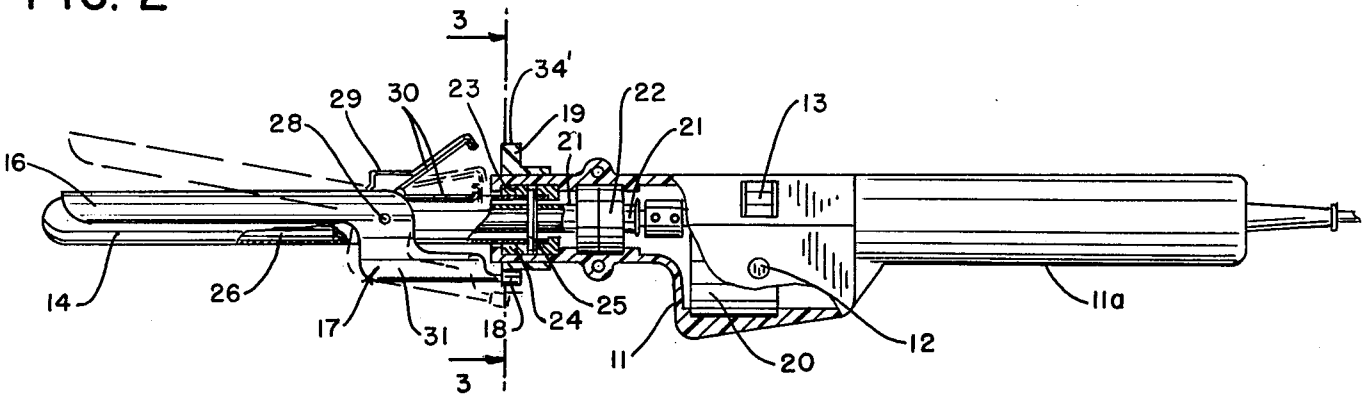
FIG. 2 is a side elevational view of the preferred embodiment of hair curler, in partial cross-sectional view.

Referring to FIG. 2, additional details of the construction of the preferred embodiment of hair curler are illustrated. A drive unit 20 that may include a motor and reduction gearing is coupled to drive shaft 21 that extends forwardly through the housing 11. The drive unit may incorporate any suitable motor, such as an electrical motor or a spring motor. Power for an electrical motor may be provided from an external source or from rechargeable batteries within the housing. Shaft 21 in turn rotates the rotatable portion of a slip ring assembly 22, the purpose of which will later be described. The forward end of housing 11 is shaped to form a bearing surface 23 that rotatably receives a bearing member 24 and is configured to limit axial movement of the bearing member. The bearing member 24 can conveniently be made of synthetic polymeric material having high lubricity. The bearing member 24 receives the base of the barrel 14 and a transversely extending pin 25 couples shaft 21, barrel 14 and bearing member 24 together so that rotation of drive shaft 21 imparts rotation to barrel 14 and bearing 24. Drive speeds on the order of 1–60 rpm are believed appropriate. It may also be desirable to have the drive means reversible.

Preferably, the curler includes means for heating the barrel 14. As shown in FIG. 2, a suitable electrical resistance heating element 26 is positioned within the barrel. Electrical power is supplied to heater 26 through a suitable power supply system that includes the switch 13 and slip ring assembly 22. In place of or in addition to the heater, the curler may also include a vapor- or steam-generating system that supplies the vapor through openings in the barrel.

Figure 5:
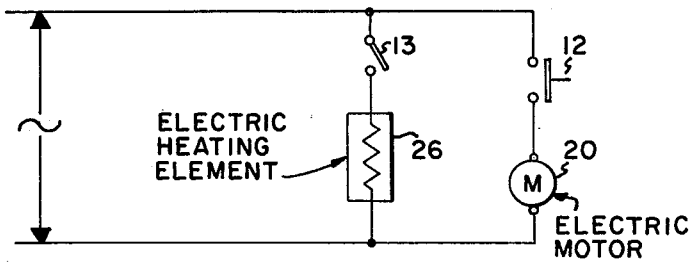
FIG. 5 illustrates the circuit diagram for the preferred embodiment.

As will be noted from FIG. 5, closing push button switch 12 will energize electrical motor 20 so that the barrel 14 rotates. If it is desired to apply heat to the hair as it is being curled, the switch 13 is thrown to the closed position and electrical current is supplied through the slip ring assembly 22 to the electrical resistance heater 26.

Continuing to refer to FIG. 2, the wrapping member 16 is pivotally mounted on the barrel 14 by means of a suitable pivot arrangement, for example, a pivot pin 28 that extends from one side of the wrapping member through the barrel 14 and to the other side of the wrapping member. The wrapping member is biased toward the full line position as shown in FIG. 2; that is, with the member 16 positioned against the barrel 14. In the preferred embodiment, a suitable biasing arrangement is provided by a reaction member 29 that is integral with the wrapping member 16 and a hairpintype spring 30, one leg of which is retained against the barrel 14 by suitable means and the other leg of which is retained by the member 29. Other biasing elements, such as coil springs, could also be utilized.

The wrapping member 16 also includes an actuating portion 17 having a leg 31 that extends beyond the pivot 28 toward the housing 11. The leg 31 includes a cam follower 18 that rests against the cam surface 34 of the cam 19.

Figure 3:
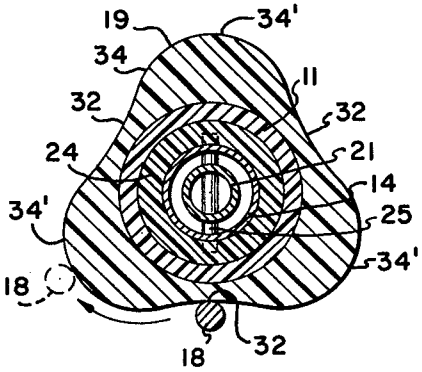
FIG. 3 is a cross-sectional view taken along section line 3—3 of FIG. 2 and illustrating the profile of the camming means of the preferred embodiment; and FIGS. *4a–4g* schematically illustrate sequential steps in an automatic curling technique in accordance with the invention.

Referring to FIGS. 2 and 3, when the cam follower 18 is positioned on one of the low points of the cam surface 32, as shown in the full line position in FIG. 3, wrapping member 16 is positioned against the barrel 14, as shown in the full line position in FIG. 2. When the drive unit 20 is energized, as by push button switch 12, the drive shaft 21 is driven, in turn causing rotation of the barrel 14. By reason of the biasing force provided by spring 30, the cam follower 18 remains in contact with the cam surface 34 and rotation of the barrel moves the follower along the surface in the direction of the arrows shown in FIG. 3. As the follower moves along the cam surface, it engages successive lobes 34' of the cam and causes the wrapping member 16 to pivot away from the barrel 14. Thus, when the follower 18 is positioned at the apex of the cam lobe, as shown in the dotted line position in FIG. 3, the wrapping member is pivoted to the dotted line position shown in FIG. 2. However, it should be realized that during this time, the entire assembly comprising the barrel 14 and the wrapping member 16 has rotated about the axis of rotation of the barrel 14.

The preferred embodiment utilizes a three-lobe cam with the apex of each lobe being angularly disposed at 120° intervals. It should be realized that it is possible to utilize different cam configurations, for example, ones having more or less than three lobes, some of which may not be equiangularly spaced with respect to others. Further, other arrangements for imparting cyclic or automatic movement (automatic in the sense that direct intervention of the user is not necessary for movement of the wrapping member relative to the barrel) to the wrapping member are within the contemplation of the invention.

Figure 4A:
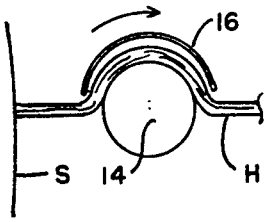

FIGS. 4*a*–4*g* schematically illustrate the sequential steps in a technique for automatically making a curl. The user first energizes the drive means by closing push button switch 12 to rotate barrel 14, and thus drive cam follower 18 along cam surface 34, so that the wrapping member 16 is moved away from the surface of the barrel 14. When the elements 14 and 16 are so positioned, a group of hair strands is separated from the remainder of the hair, usually by means of a comb or by hand, and then the curler is advanced longitudinally to position that group of hair strands H between the barrel 14 and the wrapping member 16. As shown in FIG. 4*a*, preferably the barrel is positioned close to the scalp S, desirably a distance of about 1.25 cm. The interior surface of the wrapping member 16 generally conforms to the underlying surface of the barrel 14. Preferably, the wrapping member 16 extends from 120° to 180° about the circumference of barrel 14.

Figure 4B:
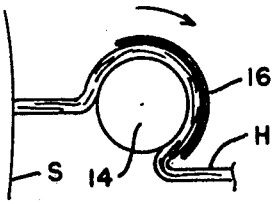

Referring to FIG. 4*b*, the barrel 14 and wrapping member 16 are rotated away from the starting position and, by reason of this rotation, the cam follower is urged to a low portion of the cam surface, thereby allowing the wrapping member 16 to press the hair against the barrel 14, while continuing to wrap the hair about the barrel. The biasing force developed by the spring 30 is such that the barrel and wrapping member 16 engage the hair with only a slight compressive force so that the surfaces of each that bear against the hair can slip relative to the hair. Too great a biasing force can result in the hair being clamped tightly against the barrel, and this would in turn tension the hair and cause discomfort to the person whose hair is being styled.

Figure 4C:
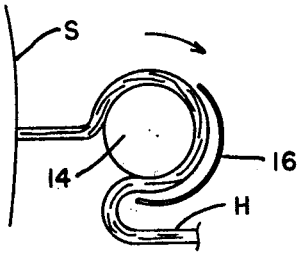

The user continues to rotate the barrel and the cam follower once again reaches a lobe of the cam to urge the wrapping member 16 away from the barrel 14. This position is shown in FIG. 4*c*. This allows tension that is being built up in the hair by reason of the wrapping operation to be relieved.

Figure 4D:
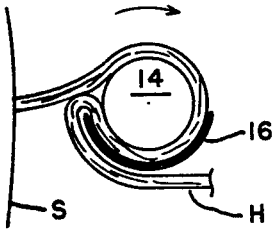

As indicated in FIG. 4*d*, as rotation of the barrel 14 is continued, additional hair is wrapped about the barrel 14.

Figure 4E:
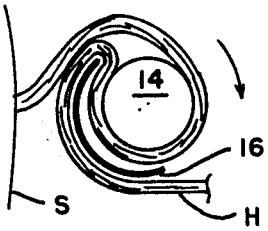
Figure 4F:
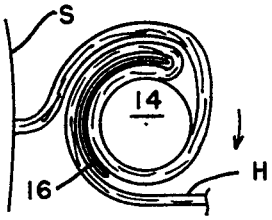
Figure 4G:
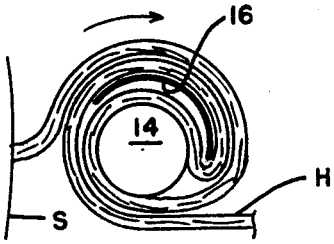

As illustrated in FIG. 4*e*, continued rotation of the barrel 14 and wrapping member 16 introduces the newly wrapped portion of hair beneath the hair previously wrapped about the barrel. Thus the newly wrapped hair always comes into contact with the heated barrel. Again, the wrapping member 16 has been urged away from the surface of barrel 14 to relieve residual tension that might result from the wrapping operation. Additional wrapping of the hair continues to take place so long as the barrel is rotated, with the wrapping member 16 alternately pressing against and moving away from the wrapped hair, as shown in FIGS. 4*f* and 4*g* respectively, until the desired length of hair is wound into a curl. In order to remove the barrel from the hair curl, rotation of the barrel is stopped with the wrapping member in an open position and the barrel is then withdrawn from the curl. In this manner, a well formed, well set curl is automatically produced in a continuous procedure, with little experience or skill necessary to achieve the results. The curling procedure can also be started at the ends of a group of hair strands. In this case, the hair ends are introduced between the barrel and the wrapping member and rotation of the barrel is initiated and continues until the length of hair desired is rolled into a curl. Curling can also be done starting at some point intermediate the scalp and the hair ends, in which case it takes place as illustrated in FIGS. 4*a*–4*g*.

A significant advantage of the disclosed curler is believed to be that a person with only a modest level of skill can curl hair well. The operation is completely automatic once the hair is positioned in the curler. The technique of starting the curl close to the scalp can be readily accomplished by the stylist or by the home user who is styling her or his own hair. Moreover, the curler can be easily manipulated in one hand, leaving the other free for styling or directing other parts of the hair. The curling procedure can be done more quickly and with less fatigue to the user.

In the embodiment described above, the barrel is rotated by the drive means and the unit comprising the barrel and the wrapping member rotates about the longitudinal axis of the barrel. However, curlers having a stationary barrel are also within the contemplation of the invention. In such arrangements, the wrapping member is separately mounted for rotation about the barrel. A cam arrangement substantially the same as that described previously can be used to cause the wrapping member to move toward and away from the barrel. An advantage of such a design is the elimination of the need for a slip ring in curlers that have an electrically heated barrel.

We claim:

1. Curling apparatus comprising: a housing;

an elongate barrel extending from the housing, said barrel forming a mandrel about which hair may be wrapped to form a curl;

means mounting the barrel for rotation about its longitudinal axis relative to the housing;

an elongate wrapping member disposed along at least a portion of the barrel, said wrapping member being mounted on the barrel for rotation therewith and adapted for movement toward the longitudinal axis of the barrel to urge the hair against the barrel and for movement away from the longitudinal axis of the barrel to relax its engagement with the hair, said wrapping member having a shape that generally conforms to the shape of the barrel surface and such that when the wrapping member is moved into contact with the barrel, the abutting surfaces are substantially in continuous contact;

means for unidirectionally rotating the barrel about its longitudinal axis and relative to the housing; and cooperating means on said housing and wrapping member for automatically and periodically moving the wrapping member toward and away from the longitudinal axis of the barrel, during each revolution of the barrel, in response to rotation of the barrel.

2. Apparatus as in claim 1 wherein the cooperating means for automatically and periodically moving the wrapping member toward and away from the longitudinal axis of the barrel comprises a cam on the housing having a camming surface and means operatively associated with the wrapping member engaging the camming surface of the cam.

3. Apparatus as in claim 1 wherein the wrapping member is generally arcuate and extends from 120° to 180° about the circumference of the barrel substantially along the longitudinal axis of the barrel.

4. Apparatus as in claim 1, 2, or 3 and further comprising means for biasing the wrapping member toward the longitudinal axis of the barrel.

5. Hair curling apparatus comprising:

a housing;

an elongate barrel extending from the housing, said barrel forming a mandrel about which hair may be wrapped to form a curl;

an elongate wrapping member disposed along at least a portion of the barrel, said wrapping member being movable toward the longitudinal axis of the barrel to urge the hair against the barrel and movable away from the longitudinal axis of the barrel to relax its engagement with the hair, said wrapping member having a shape that generally conforms to the shape of the barrel surface and such that when the wrapping member is moved into contact with the barrel, the abutting surfaces are substantially in continuous contact;

means mounting the wrapping member for movement toward and away from the longitudinal axis of the barrel; drive means for unidirectionally rotating the wrapping member about the longitudinal axis of the barrel; and cooperating means on said housing and wrapping member for automatically and periodically moving the wrapping member toward and away from the longitudinal axis of the barrel, during each revolution of the wrapping member, in response to rotation of the wrapping member.

6. Apparatus as in claim 5 wherein the cooperating means for automatically and periodically moving the wrapping member toward and away from the longitudinal axis of the barrel comprises a cam on the housing having a camming surface and means operatively associated with the wrapping member engaging the camming surface of the cam.

7. Apparatus as in claim 5 wherein the wrapping member is generally arcuate and extends from 120° to 180° about the circumference of the barrel substantially along the longitudinal axis of the barrel.

8. Apparatus as in claim 5, 6, or 7 and further comprising means for biasing the wrapping member toward the longitudinal axis of the barrel.

* * * * *